US009260845B1

(12) United States Patent
Siegel

(10) Patent No.: US 9,260,845 B1
(45) Date of Patent: Feb. 16, 2016

(54) SINK SPLASHGUARD

(71) Applicant: Daniel Siegel, Tenafly, NJ (US)

(72) Inventor: Daniel Siegel, Tenafly, NJ (US)

( * ) Notice: Subject to any disclaimer, the term of this patent is extended or adjusted under 35 U.S.C. 154(b) by 239 days.

(21) Appl. No.: 14/024,244

(22) Filed: Sep. 11, 2013

Related U.S. Application Data

(60) Provisional application No. 61/699,741, filed on Sep. 11, 2012.

(51) Int. Cl.
*A47J 47/20* (2006.01)
*E03C 1/181* (2006.01)

(52) U.S. Cl.
CPC . *E03C 1/181* (2013.01); *A47J 47/20* (2013.01)

(58) Field of Classification Search
CPC ..... E03C 1/181
USPC ..... 4/619–660
See application file for complete search history.

(56) References Cited

U.S. PATENT DOCUMENTS

| | | | | | |
|---|---|---|---|---|---|
| 998,149 | A | | 7/1911 | Barrett | |
| 1,221,137 | A | * | 4/1917 | Carney | 4/658 |
| 1,331,018 | A | * | 2/1920 | Luthy | 429/143 |
| 2,508,808 | A | * | 5/1950 | Warman | 4/658 |
| 3,444,564 | A | * | 5/1969 | Lavacchia | 4/559 |
| D325,249 | S | * | 4/1992 | Kliebert | D23/308 |
| 5,231,707 | A | * | 8/1993 | Ashley et al. | 4/557 |
| 5,351,673 | A | * | 10/1994 | Somerton | 126/214 D |
| 5,372,174 | A | * | 12/1994 | Wilke | 160/135 |
| 5,625,910 | A | * | 5/1997 | Erickson et al. | 4/658 |
| 5,815,856 | A | * | 10/1998 | Dore | 4/657 |
| 6,212,708 | B1 | * | 4/2001 | Mulaw | 4/657 |
| 6,253,395 | B1 | * | 7/2001 | Quam | 4/658 |
| 6,338,171 | B1 | * | 1/2002 | Dandridge | 4/657 |
| 6,341,388 | B1 | * | 1/2002 | Roberts | 4/609 |
| 6,401,275 | B1 | * | 6/2002 | Garner | 4/658 |
| 6,564,398 | B1 | * | 5/2003 | Trott | 4/658 |
| 6,647,899 | B1 | * | 11/2003 | Lysien | 108/24 |
| 6,701,543 | B1 | * | 3/2004 | Haq | 4/559 |
| 6,866,035 | B2 | * | 3/2005 | Haemerle | 126/214 D |
| D513,065 | S | * | 12/2005 | Luong | D23/307 |
| 6,973,927 | B1 | * | 12/2005 | Stewart | 126/98 |
| 7,328,466 | B1 | * | 2/2008 | Bowen | 4/558 |
| 8,214,939 | B2 | * | 7/2012 | Spurlock | 4/654 |
| D725,246 | S | * | 3/2015 | DiPirro | D23/308 |
| D725,755 | S | * | 3/2015 | Jones | D23/304 |
| D734,839 | S | * | 7/2015 | Jones | D23/304 |

* cited by examiner

*Primary Examiner* — Lori Baker
(74) *Attorney, Agent, or Firm* — Schmeiser, Olsen & Watts LLP

(57) ABSTRACT

A sink splashguard is provided and can be mounted to a sink such that it protrudes a height above a counter surface. The sink splashguard protects the user of the sink from splashes. The height of the sink splashguard above the counter surface can be easily and quickly adjusted while the sink splashguard is in use. The sink splashguard include a base with one or more than one side, and an adjustable attachment holder coupled to the base. The adjustable attachment holder adjustably couples to a splash guard coupling device, which can be a suction cup to be used to couple the splash guard within a sink. A splash guard include a curve body portion that is semi-flexible with coupling devices coupled in fixed positions to the body portion. The body portion contours to an inner wall of a sink.

15 Claims, 6 Drawing Sheets

SINK SPLASHGUARD

CROSS REFERENCE TO RELATED APPLICATION[S]

This application claims priority to U.S. Provisional Patent Application entitled "SINK SPLASHGUARD," Ser. No. 61/699,741, filed Sep. 11, 2012, the disclosure of which is hereby incorporated entirely herein by reference.

BACKGROUND OF THE INVENTION

1. Technical Field

This invention relates to sinks and wash basins and in particular to a splashguard for protecting the user of a sink from getting splashed by water from the sink.

2. State of the Art

Sinks and washbasins are in common use in kitchens and washrooms in homes and businesses. Sinks and washbasins are used for preparing of foods, washing dishes, washing clothes, or for washing hands and/or arms. Sinks by their nature involve the use of water, and many chores done by a sink result in the user of the sink getting splashed with water. Splashguards can be used to protect the user of a sink from getting splashed with water from the sink. Current splashguard technology does not provide a splashguard that can be easily and repeatably removed from the sink, is easy for the user to reach over and into the sink, and can be easily adjusted in height above the counter.

Accordingly, a novel sink splashguard has been developed which can be easily and repeatably attached and removed from the sink, and can be easily adjusted in height above the counter.

DISCLOSURE OF THE INVENTION

The disclosed invention relates to sinks and wash basins and in particular to a splashguard for protecting the user of a sink from getting splashed by water from the sink.

Disclosed is a splash guard for use in a sink. The splash guard includes a base, one or more than one side coupled to the base, and an adjustable attachment holder coupled to the base. The adjustable attachment holder removeably and adjustably couples the splash guard to the sink. In some embodiments the splash guard includes a top side, a first edge side, and a second edge side. In some embodiments the adjustable attachment holder includes a rail, and one or more than one tab coupled to the rail. In some embodiments each of the one or more than one tab is configured to hold a splash guard coupling device. In some embodiments the splash guard coupling device is a suction cup. In some embodiments the tab includes a hole, where the hole receives a suction cup base, and a slot, where the slot removeably couples to the suction cup base. In some embodiments the adjustable attachment holder includes a plurality of tabs coupled to the rail.

Disclosed is a splash guard for use in a sink. The splash guard includes a body portion having a top edge, a bottom edge, a first side end and a second side end, wherein the body portion is a curved shape; and a plurality of coupling devices coupled to the body portion, wherein the coupling devices removably and adjustably couple the splash guard to a sink. The plurality of coupling devices is coupled along a length of the body portion between the first end and the second end. In embodiments, the coupling devices are evenly spaced along the length of the body portion, wherein the coupling devices are coupled in fixed locations to an outer surface of the body portion. Further, the body portion is semi-flexible, wherein the body portion is bendable about lines that are transverse to the top edge of the body portion. Because of this flexibility, the body portion is configured to contour to a curved shape inner wall of the sink to which the splash guard is coupled.

Disclosed is a method of protecting a user of a sink from splashes with a splash guard according to the invention, the method comprising coupling a splash guard coupling device to a splash guard; attaching the splash guard coupling device to a sink wall of the sink; and adjusting a height of a top side of the splash guard above a counter surface The method may also comprise the step of mounting an adjustable attachment holder to a splash guard base of the splash guard and the step of removeably coupling a splash guard coupling device to a first one of a plurality of tabs of the adjustable attachment holder. The method of protecting a user of a sink from splashes with a splash guard according to the invention also includes the steps of attaching the splash guard coupling device to a sink wall of the sink, and un-coupling the splash guard coupling device from the first one of the plurality of tabs of the adjustable attachment holder. The method of protecting a user of a sink from splashes with a splash guard according to the invention also includes the step of removeably coupling the splash guard coupling device to a second one of the plurality of tabs of the adjustable attachment holder, where the height of a splash guard top side of the splash guard above a counter surface is adjusted in response to un-coupling the splash guard coupling device from the first one of the plurality of tabs and coupling the splash guard coupling device to a second one of the plurality of tabs.

The foregoing and other features and advantages of the invention will be apparent to those of ordinary skill in the art from the following more particular description of the invention and the accompanying drawings.

DETAILED DESCRIPTION OF EMBODIMENTS OF THE INVENTION

As discussed above, embodiments of the present invention relate to sinks and wash basins and in particular to a splashguard for protecting the user of a sink from getting splashed by water from the sink. The sink splashguard according to the invention uses an adjustable attachment holder to mount the sink splashguard according to the invention to the inner surface of the sink. The disclosed sink splashguard protects the user of a sink from getting splashed with water from the sink. The adjustable attachment holder allows the user to easily and quickly adjust the height of the splashguard above the counter surface. The height of the splashguard above the counter surface can be adjusted in order to adjust for shorter or taller users of the sink, and/or to provide more or less protection to the user of the sink. Less protection from splashes might be needed when the sink is being used with water only, when the user is shorter in height, or when the user is less concerned about getting water on themselves. More protection may be needed when the sink is being used with chemicals or paints, when the user is taller in height, or when it is more critical to keep all splashes off of the user.

Figure 1:
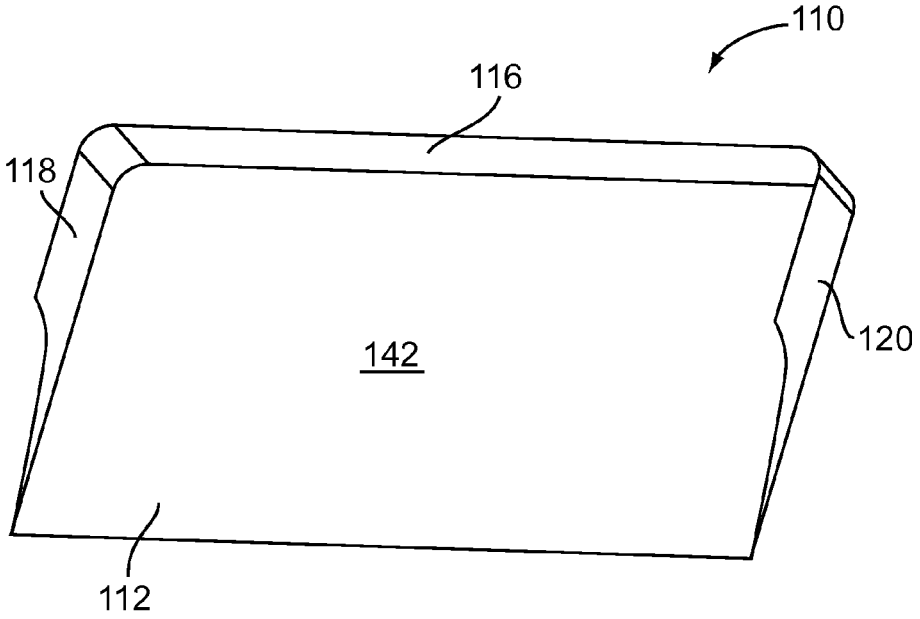
FIG. 1 is a top perspective view of one embodiment of sink splashguard 110 according to the invention.
Figure 2:
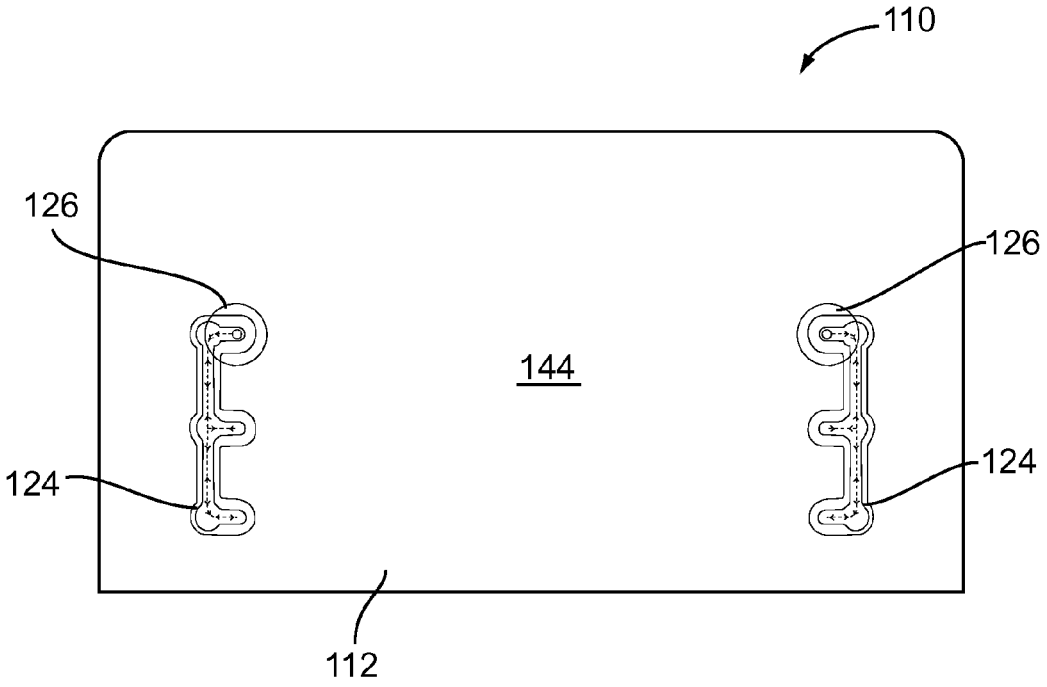
FIG. 2 is a bottom perspective view of sink splashguard 110 of FIG. 1.
Figure 3:
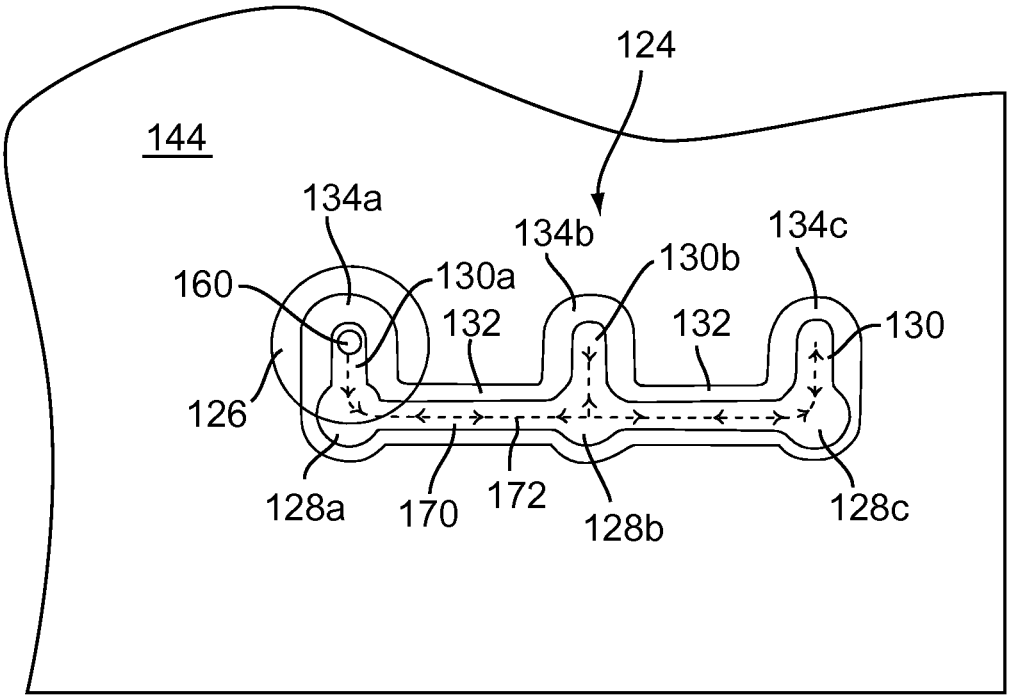
FIG. 3 shows a front view of an embodiment of adjustable attachment holder 124 according to the invention.
Figure 4:
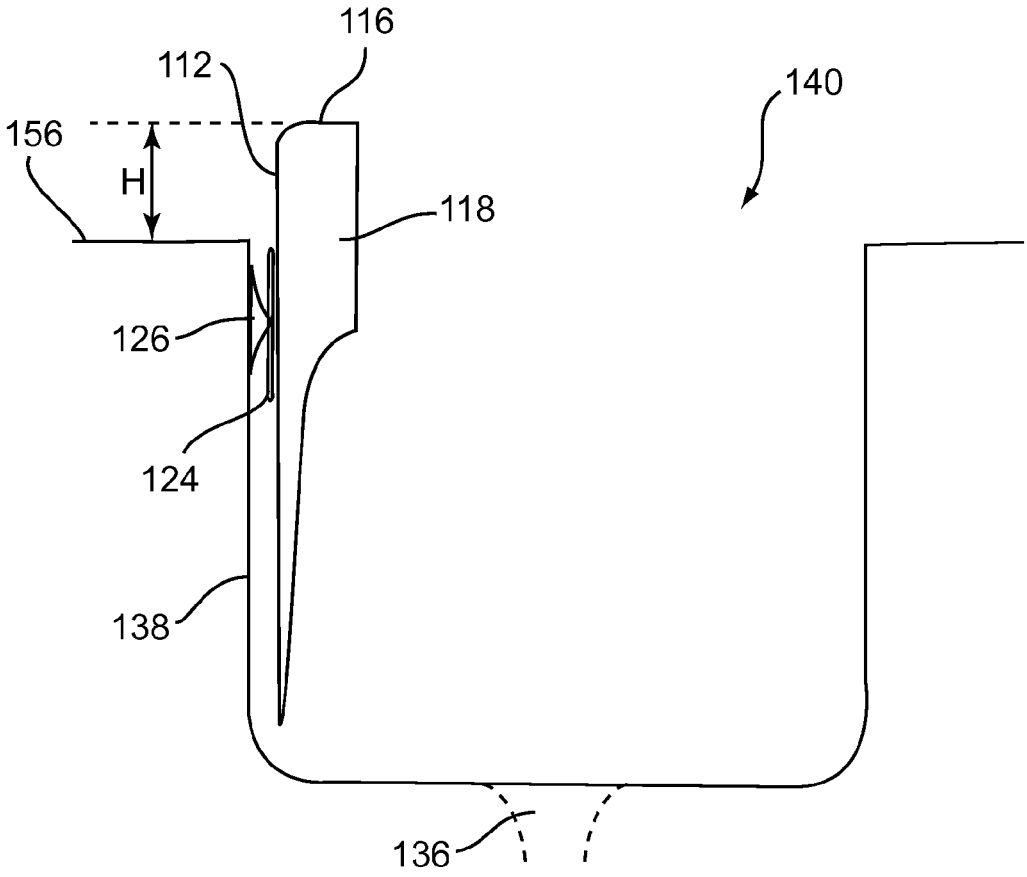
FIG. 4 is a side cutaway view of sink splashguard 110 of FIG. 1 as it is used in sink 140.
Figure 5:
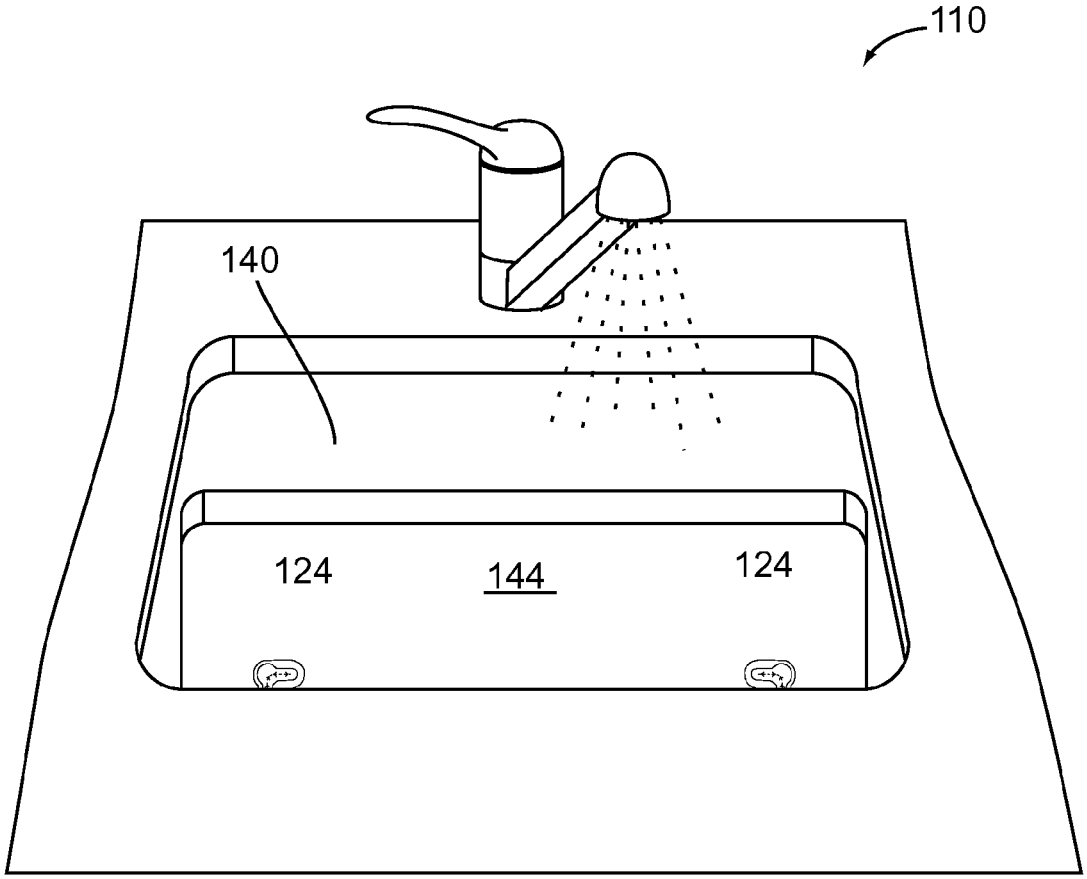
FIG. 5 is a picture of a sink 140 from the standpoint of the user of sink 140, where sink 140 has splashguard 110 of FIG. 1 coupled to it.

FIGS. 1 and 2 show two views of splashguard 110 according to the invention. FIG. 3 shows a front view of an embodiment of adjustable attachment holder 124 according to the invention. FIG. 4 shows a cross section view of splashguard 110 according to the invention mounted in a sink 140 ready for use. FIG. 5 shows a perspective view of splashguard 110 of FIG. 1 through FIG. 3 mounted in sink 140.

Figure 6:
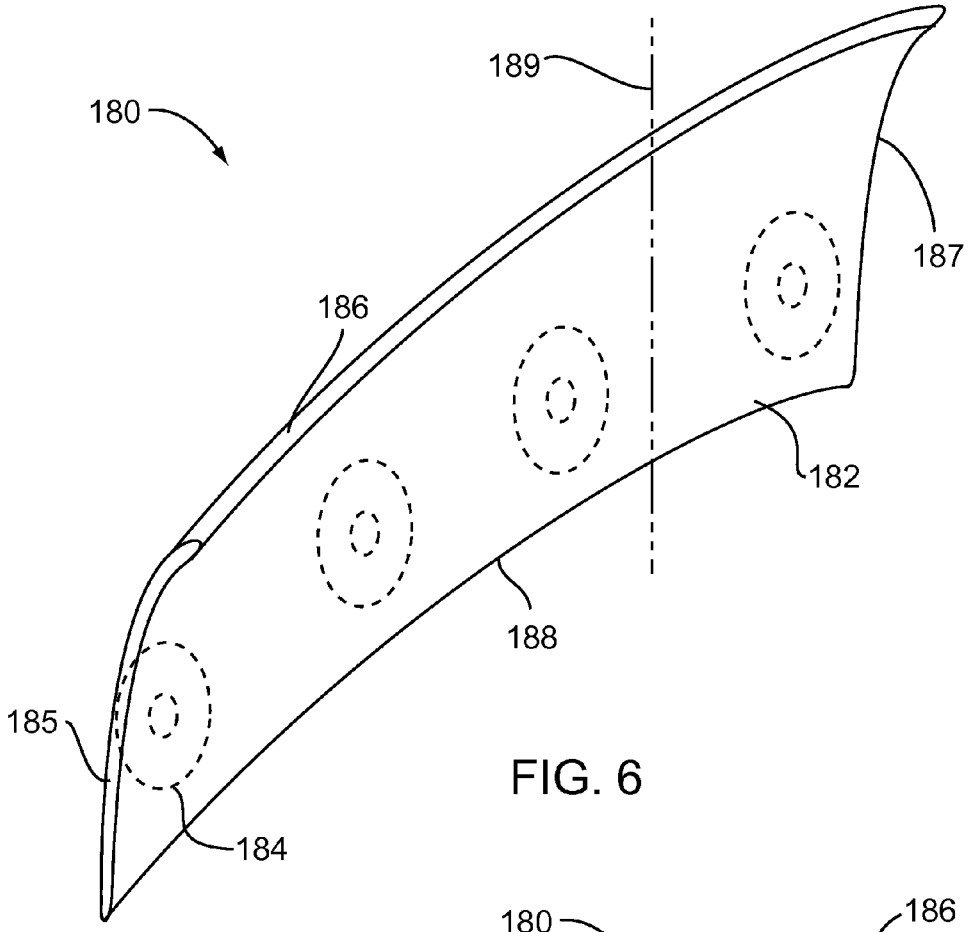
FIG. 6 shows a perspective view of another embodiment of a splashguard 180.
Figure 7:
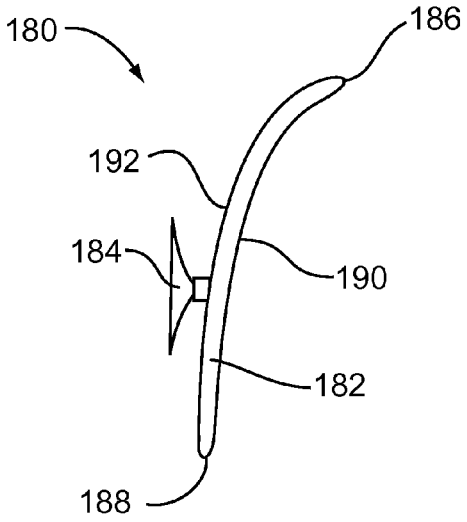
FIG. 7 is a side view of the splashguard 180 of FIG. 6.

Splashguard 110 according to the invention includes base 112 with one or more than one adjustable attachment holder 124 coupled to base 112, as shown in the figures. Base 112 is mounted to sink wall 138 as shown in FIG. 5 through FIG. 7. Base 112 is mounted to sink wall 138 with part of base 112 sticking a height H above counter surface 156 as shown in FIG. 4. The portion of base 112 that sticks above counter surface 156 protects users of sink 140 from splashes of water or other mixtures or liquids being used in sink 140. It is desirable for the user to be able to easily and quickly adjust height H, and adjustable attachment holder 124 of splashguard 110 according to the invention provides this capability, as is explained in more detail below.

In the embodiment shown in the figures, splash guard 110 according to the invention includes base 112, where base 112 includes three sides, top side 116, first edge side 118, and second edge side 120. In some embodiments base 112 has no sides. In some embodiments base 112 has sides coupled to one or more of its edges. Sides 116, 118, and 120 extend from the edges of base 112 towards the interior of sink 140, and provide additional blockage of splashes from sink 140. Sides 116, 118, and 120 can be shaped or sized differently according to the shape of sink 140, the amount of protection from splashes required, and the ease of access around splashguard 110 that is desired. In situations where sink 140 is used for hazardous or dangerous materials, for instance, sides 116, 118, and 120 may be larger to provide more protection for the arms of the user. Side 116, 118, and 120 can be made in any shape or size and attached to base 112 in any manner which facilitates protecting a user from splashes while base 112 is coupled to sink wall 138. In the embodiment shown in the figures, top side 116 has a width which extends about 2 inches from base 112. First edge side 18 and second edge side 120 are tapered, extending about 2 inches from base 112 at the edge where first or second edge side 118 or 120 meet top side 116, and tapering off in width until there is no width to first and second edge side 118 and 120 at the bottom end of base 112, as shown in the figures.

Base 112 has inner surface 142 (FIG. 1) and outer surface 144 (FIG. 2). Inner surface 142 faces the interior of sink 140. Outer surface 144 faces sink wall 138. Outer surface 144 of base 112 has one or more than one adjustable attachment holder 124 mounted to it, as can be seen in the figures. Adjustable attachment holder 124 according to the invention includes means for holding one or more than one splashguard coupling device 126. In the embodiments shown in the figures, each adjustable attachment device 124 has means for holding one splash guard coupling device 126, where the splash guard coupling device 126 is suction cup 126. Splash guard coupling device 126 couples to sink wall 138 to removeably attach splash guard 110 to sink wall 138 of sink 140.

Adjustable attachment holder 124 is mounted to base outer surface 144 (FIG. 2 and FIG. 3). Adjustable attachment holder 124 holds one or more than one splash guard coupling device 126, so that when splash guard coupling device 126 is coupled to sink wall 138, splash guard 110 is coupled to sink wall 138. In the embodiments shown, splash guard 110 includes two adjustable attachment holders 124. In some embodiments splash guard 110 includes on adjustable attachment holder 124. In some embodiments splash guard 110 include more than two adjustable attachment holders 124. In the embodiments shown, each adjustable attachment holder 124 holds one suction cup 126. Each adjustable attachment holder 124 adjustably holds one suction cup 126. Adjustable attachment holder 124 holds suction cup 126 adjustably so that splash guard 110 can be adjusted up and down to adjust height H of top side 116 above counter surface 156.

Adjustable attachment holder 124 includes one or more than one tab 124, where each tab 124 is configured to hold suction cup 126. Attachment holder 124 can be best seen in FIG. 2 and FIG. 3. In the embodiments shown in the figures, adjustable attachment holder 124 includes rail 132 and tabs 134. Each tab 134 is able to hold a suction cup 126. In the embodiment shown, moving suction cup 126 from one tab 134 to another tab 134 adjusts the height H of top edge 116 of splash guard 110 above counter surface 156.

Rail 132 is coupled to outer surface 144 of base 112. One or more than one tab 134 is coupled to rail 132. In the embodiments shown, rail 132 is a straight elongate length of rigid plastic. Rail 132 can be any shape or size that couples to outer surface 144. In the embodiments shown, rail 132 includes three tabs 134, first tab 134*a*, second tab 134*b*, and third tab 134*c*. Each tab 134 has a hole 128 and a slot 130. Suction cup base 160 fits through one of the holes 128, and is held securely when suction cup base 160 is slid into slot 130. In FIG. 3, suction cup base 160 of suction cup 126 has been placed through hole 128*b*. Suction cup base 160 will be securely held by tab 134*b* by sliding suction cup base 160 into slot 130*b*. With suction cup base 160 held securely in slot 130*b*, suction cup 126 can be attached to sink wall 138, and splashguard 110 will be held to sink wall 138.

The height of splashguard 110 above counter surface 156 is adjusted by moving base 160 of suction cup 126 from one tab 134 to another. For example, moving base 160 of suction cup 126 from tab 134*b* as shown in FIG. 2, to tab 134*a*, will increase the height H of top side 116 above counter surface 156. Conversely, moving suction cup base 160 to tab 134*c* will decrease height H above counter surface 156 of top side 116. Height H can be adjusted in response to un-coupling suction cup 126 from one tab 134 and coupling suction cup 126 to another tab 134. Un-coupling suction cup 126 from tab 134*b* and coupling suction cup to tab 134*a* will increase height H. Un-coupling suction cup 126 from tab 134*b* and coupling suction cup to tab 134*c* will decrease height H. In this way adjustable attachment holder 134 allows height H to be adjusted. Suction cup 126 can be un-coupled from one tab 134 and coupled to a different tab 134 while suction cup 126 is attached to sink wall 138. Thus the height of splashguard 110 can be adjusted while splashguard 110 is being used. Height H can be adjusted while splashguard 110 is in use by the user grasping base 112 and sliding it to the right or to the left (depending on which way adjustable attachment device 124 is mounted to base 112) to slide suction cup base 160 out of slot 130 to hole 128. Suction cup base 160 can then be removed from the one hole 128 and put into another hole 128.

Moving base 112 such that suction cup base 160 slides into the new slot 130 will secure suction cup base 160 into the new slot 130, completing the adjustment of height H. This movement can be accomplished easily and quickly while splashguard 110 is in use.

FIG. 3 shows an embodiment of adjustable attachment holder 124 in which rail 132 includes rail slot 170. Rail slot 170 extends from first tab 134*a* to third tab 134*c* along the complete length of rail 132. In this embodiment suction cup base 160 can slide along rail slot 170 to each of the slots 130. Path 172 shows the path suction cup base 160 can travel along from one slot 130 to another. In this embodiment suction sup base 160 can move from one slot to another without removing suction cup base 160 of suction cup 126 from adjustable attachment device 124. Rail slot 170 makes it easy to adjust height H. For example, suction cup base 160 can be moved from slot 130*a*, as shown in FIG. 3, to slot 130*c* by sliding suction cup base 160 along path 172 of rail slot 170.

Figure 8:
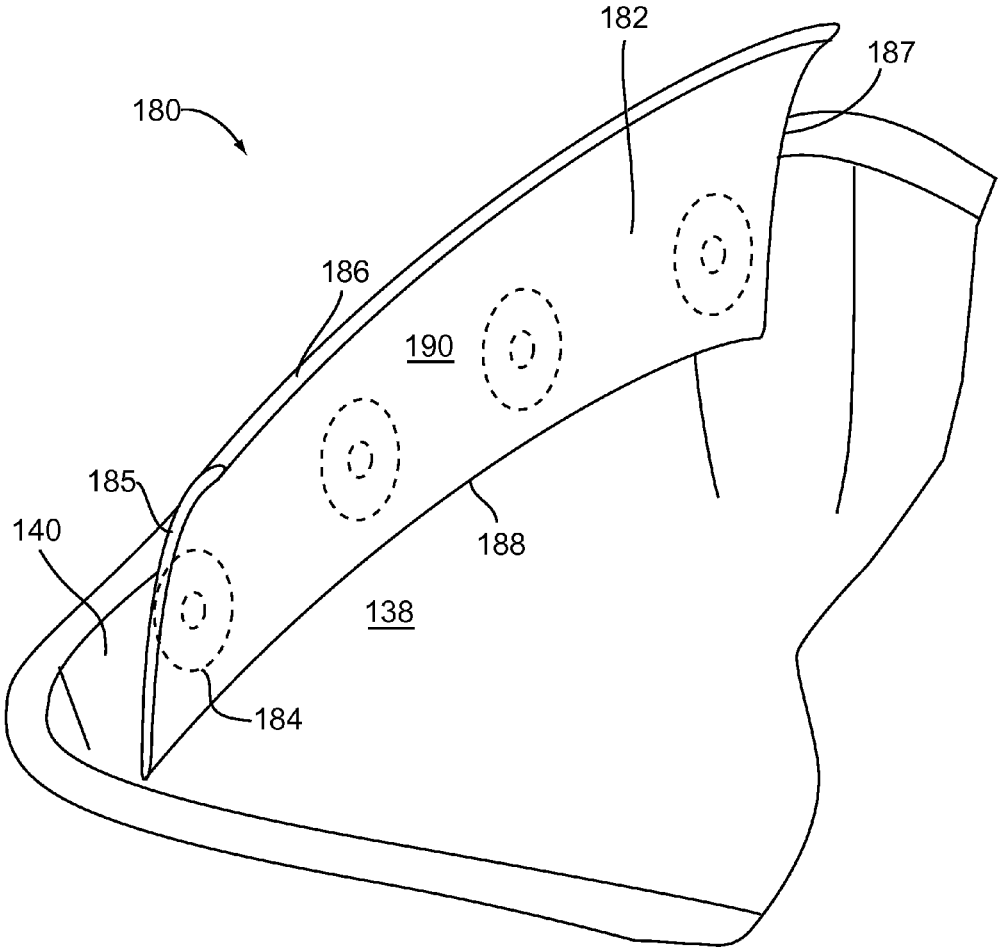
FIG. 8 is a perspective view of the splashguard 180 of FIGS. 6 and 7 as it is used in sink 140.

Another embodiment of the present invention includes a splash guard 180 as shown in FIGS. 6 and 7 and further how the splash guard 180 is coupled to a sink 140 as shown in FIG. 8.

Referring to FIGS. 7 and 8, the splash guard 180 comprises a body portion 182, wherein the body portion comprises a top edge 186, a first side end 185 and an opposing second side end 187 and a bottom end 188. The splash guard 180 further comprises a plurality of coupling devices 184. The plurality of coupling device 184 may be coupled along a length of the body portion 182 between the first end 185 and the second end 187. The coupling devices 184 may be evenly spaced along the length of the body portion 182 and further may be coupled in fixed locations to the outer surface 192 of the body portion 182. In some embodiments, the coupling devices 184 are suction cups.

Referring particularly to FIG. 7, the side view of the splash guard 180 shows the body portion 182 as a curved member. In embodiments, the body portion 182 is curved, such that the top edge 186 curves in a direction that the inner surface 190 faces. The curve body portion 182 functions to improve the protection of splashing, while not requiring the body portion 182 to extend to such high distances above the edge of the sink 140. The curved shape allows for easier usage of the sink 140 when the splash guard 180 is coupled to the inner wall 138 of the sink 140. As seen in FIG. 8 the curved shape of body portion 182 curves the top edge 186 away from inner wall 138 of the sink 140 and further toward the inner portion of the sink 140.

In use, the splash guard 180 is removably attached to an inner wall 138 of sink 140, wherein the coupling devices 184 may be removed and coupled again to the inner wall 138 of the sink 140 in various locations, wherein the height of the splash guard 180 above a top edge of the sink can be varied dependent upon the location of where the coupling device 184 are coupled to the inner wall 138. Accordingly, coupling the coupling devices closer to the top edge of the sink 140 extends the body portion 182 of the splash guard 180 higher above the top edge of the sink 140. Likewise, attaching the coupling devices 184 further away from the top edge of the sink 140 results in the body portion being lower with respect to the top edge of the sink 140.

In particular embodiments, the body portion 182 may be semi flexible. The body portion 182 may be bendable or curveable about lines that are transverse to the top edge 186 of the body portion 182. For example, line 189 is transverse to the top edge 186 of the body portion 182, wherein the body portion 182 may be curved about the line 189. The body portion 182 may be curved about line 189 toward the inner surface 190 or may be curved about another line parallel to line 189 toward the outer surface 192. This ability to curve the body portion 182 about lines transverse to the top edge 186 allows for the splash guard 180 to be coupled along inner wall surface 138 of the sink 140 that is not flat, but is rounded or has some other curved geometry. In at least this way, the body portion 182 is configured to contour to the shape of the inner wall 138 of the sink 140.

A method of protecting a user of a sink from splashes is disclosed. The method of protecting a user of a sink from splashes according to the invention includes the step of coupling a splash guard coupling device to a splash guard; attaching the splash guard coupling device to a sink wall of the sink; and adjusting a height of a top side of the splash guard above a counter surface.

In some embodiments, the method may also include mounting an adjustable attachment holder to a splash guard base of the splash guard. The method also includes the steps of removably coupling a splash guard coupling device to a first one of a plurality of tabs of the adjustable attachment holder, and attaching the splash guard coupling device to a sink wall of the sink. The method of protecting a user of a sink from splashes according to the invention also includes the steps of un-coupling the splash guard coupling device from the first one of the plurality of tabs of the adjustable attachment holder, and removably coupling the splash guard coupling device to a second one of the plurality of tabs of the adjustable attachment holder. The height of a splash guard top side of the splash guard above a counter surface is adjusted in response to un-coupling the splash guard coupling device from the first one of the plurality of tabs and coupling the splash guard coupling device to a second one of the plurality of tabs.

In other embodiments, the method step of adjusting the height of the tip side of the splash guard above the counter surface comprises detaching the splash guard coupling device from the sink wall and reattaching the coupling device to a different location on the sink wall. Further, the method in these embodiments may also include contouring a body portion of the splash guard to correspond to a contour of the sink wall.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A splash guard comprising:

a base;

one or more than one side coupled to the base; and an adjustable attachment holder coupled to the base, the adjustable attachment holder comprising a rail, and one or more than one tab coupled to the rail, wherein each of the one or more than one tab is configured to hold a splash guard coupling device, wherein the adjustable attachment holder removably and adjustably couples the splash guard to a sink.

2. The splash guard of claim 1, wherein the splash guard coupling device is a suction cup.

3. The splash guard of claim 1, wherein the tab comprises:

a hole, wherein the hole receives a suction cup base; and a slot, wherein the slot removably couples to the suction cup base.

4. The splash guard of claim 1, wherein the one or more than one side comprises:

a top side coupled to a base top edge;

a first edge side coupled to a base first side edge of the base; and a second edge side coupled to a base second side edge of the base.

5. A splash guard comprising:

a body portion having a top edge, a bottom edge, a first side end and a second side end, wherein the body portion is a curved shape, is semi-flexible, and is bendable about lines that are transverse to the top edge of the body portion; and a plurality of coupling devices coupled to the body portion, wherein the coupling devices removably and adjustably couple the splash guard to a sink.

6. The splash guard of claim 5, wherein the plurality of coupling device are coupled along a length of the body portion between the first end and the second end.

7. The splash guard of claim 6, wherein the coupling devices are evenly spaced along the length of the body portion.

8. The splash guard of claim 7, wherein the coupling devices are coupled in fixed locations to an outer surface of the body portion.

9. The splash guard of claim 5, wherein the splash guard coupling devices are suction cups.

10. The splash guard of claim 5, wherein the body portion is configured to contour to a curved shape inner wall of the sink to which the splash guard is coupled.

11. A method of protecting a user of a sink from splashes with a splash guard, the method comprising:

mounting an adjustable attachment holder to a splash guard base of a splash guard;

removably coupling a splash guard coupling device to a first one of a plurality of tabs of the adjustable attachment holder;

attaching the splash guard coupling device to a sink wall of the sink; and adjusting a height of a top side of the splash guard above a counter surface.

12. The method claim 11, further comprising un-coupling the splash guard coupling device from the first one of the plurality of tabs of the adjustable attachment holder.

13. The method of claim 12, further comprising removably coupling the splash guard coupling device to a second one of the plurality of tabs of the adjustable attachment holder, wherein the height of a splash guard top side of the splash guard above a counter surface is adjusted in response to un-coupling the splash guard coupling device from the first one of the plurality of tabs and coupling the splash guard coupling device to a second one of the plurality of tabs.

14. The method of claim 11, wherein adjusting the height of the top side of the splash guard above the counter surface comprises detaching the splash guard coupling device from the sink wall and reattaching the coupling device to a different location on the sink wall.

15. The method of claim 11, further comprising contouring a body portion of the splash guard to correspond to a contour of the sink wall.

* * * * *